US007549794B2

(12) United States Patent
Fukuda

(10) Patent No.: US 7,549,794 B2
(45) Date of Patent: Jun. 23, 2009

(54) IN-FURNACE TEMPERATURE MEASURING METHOD

(75) Inventor: Takashi Fukuda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 531 days.

(21) Appl. No.: 11/387,868

(22) Filed: Mar. 24, 2006

(65) Prior Publication Data

US 2007/0144626 A1 Jun. 28, 2007

(30) Foreign Application Priority Data

Dec. 26, 2005 (JP) ..... 2005-372309

(51) Int. Cl.
*G01K 13/04* (2006.01)
*G01K 1/20* (2006.01)
*F27B 9/00* (2006.01)

(52) U.S. Cl. ..... 374/149; 374/120; 374/2; 324/760; 324/158.1; 702/99; 702/130; 219/388

(58) Field of Classification Search ..... 374/1, 374/2, 4, 5, 43–45, 57, 29–31, 141, 142, 374/149, 166, 120–121, 122, 124, 109, 112, 374/137, 170, 110; 700/300; 702/99, 130–135; 324/158.1, 760–765; 219/388
See application file for complete search history.

(56) References Cited

U.S. PATENT DOCUMENTS 4,459,103 A * 7/1984 Gieskieng ..... 432/43
5,148,003 A * 9/1992 Haj-Ali-Ahmadi et al. .. 219/388
6,037,645 A * 3/2000 Kreider ..... 257/467
6,190,040 B1 * 2/2001 Renken et al. ..... 374/185
6,225,141 B1 * 5/2001 Wenner et al. ..... 438/54
6,257,319 B1 * 7/2001 Kainuma et al. ..... 165/11.1
6,511,223 B1 * 1/2003 Austen et al. ..... 374/166
6,520,675 B1 * 2/2003 Breunsbach et al. ..... 374/142
6,971,793 B2 * 12/2005 Tsui et al. ..... 374/121
7,042,240 B2 * 5/2006 Lopez et al. ..... 324/760
7,071,721 B2 * 7/2006 Furukawa ..... 324/765
2003/0038365 A1 * 2/2003 Farnworth et al. ..... 257/723
2005/0267645 A1 * 12/2005 Fenk ..... 700/300

FOREIGN PATENT DOCUMENTS

JP 10-051127 2/1998
JP 2004-245732 9/2004

* cited by examiner

*Primary Examiner*—Gail Verbitsky
(74) *Attorney, Agent, or Firm*—Staas & Halsey LLP

(57) ABSTRACT

There is provided an in-furnace temperature measuring method that is capable of reducing the number of operation steps that are required for temperature measurement, and effectively applying a measurement result even if colors and finishing states of a circuit board and an electronic part are changed. First and second pseudo circuit boards (12) and (13) having the substantially same configuration and dimensions as those of a circuit board are inserted into a reflow furnace (11), the front and rear surface temperatures of the first and second pseudo circuit boards (12) and (13) and air temperatures around the first and second pseudo circuit boards (12) and (13) within the reflow furnace (11) are measured. The entire surface of a metal whose physical value is known is black-coated in the first pseudo circuit board (12), and the entire surface of a metal whose given physical value is known is mirror-finished in the second pseudo circuit board (13).

3 Claims, 4 Drawing Sheets

IN-FURNACE TEMPERATURE MEASURING METHOD

BACKGROUND OF THE INVENTION

1. Field of the Invention

The present invention relates to an in-furnace temperature measuring method that is suitable in a temperature measurement for a reflow furnace or the like that requires a temperature management.

2. Description of the Related Technology

For example, electronic parts that are soldered onto a printed circuit board by a reflow furnace are being enhanced in performance and densely implemented. For that reason, the diversification of the electronic parts (large-sized, small-sized, etc.) is advanced, and the necessity of the temperature management within the reflow furnace is more and more required. Also, a precision in temperature measurement which is required for the temperature analysis within the reflow furnace has been improved.

Up to now, in the case of measuring the temperature within the reflow furnace, as shown in FIG. 5, a printed circuit board 51, whose given physical values (specific heat, density, heat transfer coefficient, etc.) have been known, or the like is inserted into a reflow furnace 52, and a surface temperature of the printed circuit board 51 is measured at given positions 52*a* and 52*b*.

In addition, an air temperature within the reflow furnace 52 is measured in a state where the printed circuit board 51 is not inserted into the reflow furnace 52. For example, a thermo couple 53 is used in those temperature measurements. In addition numeral 54 shown in FIG. 5 denotes conveying device.

However, in the conventional temperature measuring method, since the temperature measurement operation of plural times is required in order to obtain necessary data, there arises such a problem in that the number of operation steps is increased.

Also, since the printed circuit board 51 or the like used in the temperature measurement is colored with substantially the same color as that of an actual printed circuit board, there arises such a problem in that the measurement results cannot be applied to a printed circuit board that is different in the color and a finishing state from the printing circuit board 51 as they are.

Also, because the surface temperature of the printed circuit board 51 for examination and the air temperature within the reflow 52 are measured, individually, there arises such a problem in that it is difficult to determine the temperature in a state where the electronic parts are mounted on the actual printed circuit board.

In addition, since the surface temperature of the printed circuit board 51 and the air temperature within the reflow furnace 52 are measured, separately, there arises such a problem in that the positional displacement of the measured position occurs, and the reliability of the measured result is lowered.

The above problems occur not only in the reflow furnace, but also in various furnaces that require the temperature management.

[Patent Document 1] JP2004-245732A

[Patent Document 2] JP01-51127A

SUMMARY OF THE INVENTION

The present invention has been made in view of the above problems, and therefore, an object of the present invention is to provide an in-furnace temperature measuring method which is capable of reducing the number of operation steps required in the temperature measurement, applying the measurement result even if an object to be heated or a circuit board and electronic parts are changed in the color and finishing state, and measuring the surface temperature of the object to be heated or the circuit board, and the air temperature around the object or the circuit board at the same time.

In order to achieve the above object, the present invention applies the following devices.

(1) The present invention provides an in-furnace temperature measuring method in which first and second pseudo objects to be heated having the substantially same configuration and dimensions as those of an object to be heated are inserted into a furnace for heating the object to be heated, a surface temperature of the pseudo object to be heated and an air temperature around the pseudo object to be heated within the furnace are measured comprising steps of; black-coating the entire surface of a metal whose physical value is known in the first pseudo object to be heated; mirror-finishing the entire surface of a metal whose given physical value is known in the second pseudo object to be heated; and measuring the surface temperatures at given positions in the first and second pseudo objects to be heated within the furnace and air temperatures around the pseudo objects to be heated.

In the present invention, since the surface temperatures of the first pseudo object to be heated whose entire surface is black-coated, and the second pseudo object to be heated whose entire surface is mirror-finished at the given positions are measured at the same time of measuring the air temperature around the given positions, the efficiency of the temperature measurement operation is improved.

Also, the temperatures of the first pseudo object to be heated whose entire surface is black-coated and very high in the heat absorption and the second pseudo object to be heated whose entire surface is mirror-finished and very low in the heat absorption are used to measure the temperature within the furnace. As a result, even in the case where the surfaces of various objects to be heated and the objects that are mounted on the actual circuit board are different in the color and the finish state, the temperature measurement results can be effectively used.

(2) Further, the present invention provides an in-reflow-furnace temperature measuring method in which first and second pseudo circuit boards having the substantially same configuration and dimensions as those of a circuit board are inserted into a reflow furnace for soldering an electronic part onto the circuit board, the surface temperatures of the first and second pseudo circuit boards and air temperatures around the first and second pseudo circuit boards within the furnace are measured comprising of; black-coating the entire surface of a metal whose physical value is known in the first pseudo circuit board; mirror-finishing the entire surface of a metal whose given physical value is known in the second pseudo circuit board; conveying the first and second pseudo circuit boards within the reflow furnace at the substantially same speed as the conveying speed of the circuit board within the reflow furnace; and measuring the surface temperatures at given positions in the first and second pseudo circuit boards within the furnace and air temperatures around the first and second pseudo circuit boards.

In the present invention, since the surface temperatures of the first pseudo circuit board whose entire surface is black-coated, and the second pseudo circuit board whose entire surface is mirror-finished at the given positions are measured at the same time of measuring the air temperature around the given positions, the efficiency of the temperature measurement operation is improved.

Also, the temperatures of the first pseudo circuit board and the second pseudo circuit board are measured at the same time, thereby making it possible to suppress the temperature measurement positions from being displaced between those two pseudo circuit boards.

Also, the first pseudo circuit board whose entire surface is black-coated that is very high in the heat absorption and the second pseudo circuit board whose entire surface is mirror-finished that is very low in the heat absorption are used to measure the temperature within the furnace. As a result, even in the case where the surfaces of the actual circuit board and the electronic parts that are mounted on the actual circuit board are different in the color and the finish state, the temperature measurement results can be effectively used. This is because the colors and the finish states of the actual circuit board and the electronic parts exist between black-coat and the mirror finish.

(3) It is preferable that temperature measuring devices are disposed at the given positions of the surfaces of the first and second pseudo circuit boards, and the temperature measuring devices are held above and below the given positions by holding devices.

In this case, the given positions of the first and second pseudo circuit boards and the air temperatures above and below the given positions can be accurately measured.

(4) It is preferable that the given positions are positions at which the electronic parts that are lower in allowable temperature limit than other electronic parts among the electronic parts are mounted, or positions at which the heating temperature by the reflow furnace is higher than others.

As described above, according to the present invention, it is possible to reduce the number of operation steps that are required in the temperature measurement within the furnace or the reflow furnace which require the temperature management. Also, even in the case where the object to be heated, goods that are attached onto the object to be heated, or the circuit board and the electronic parts that are soldered onto the circuit board are changed in the surface color or the finish state, the temperature measurement result can be effectively applied.

Also, since the displacement of the temperature measurement positions can be suppressed between the first and second pseudo objects to be heated and between the first and second pseudo circuit boards, the reliability of the temperature measurement is improved.

DETAILED DESCRIPTION OF THE INVENTION

Figure 1:
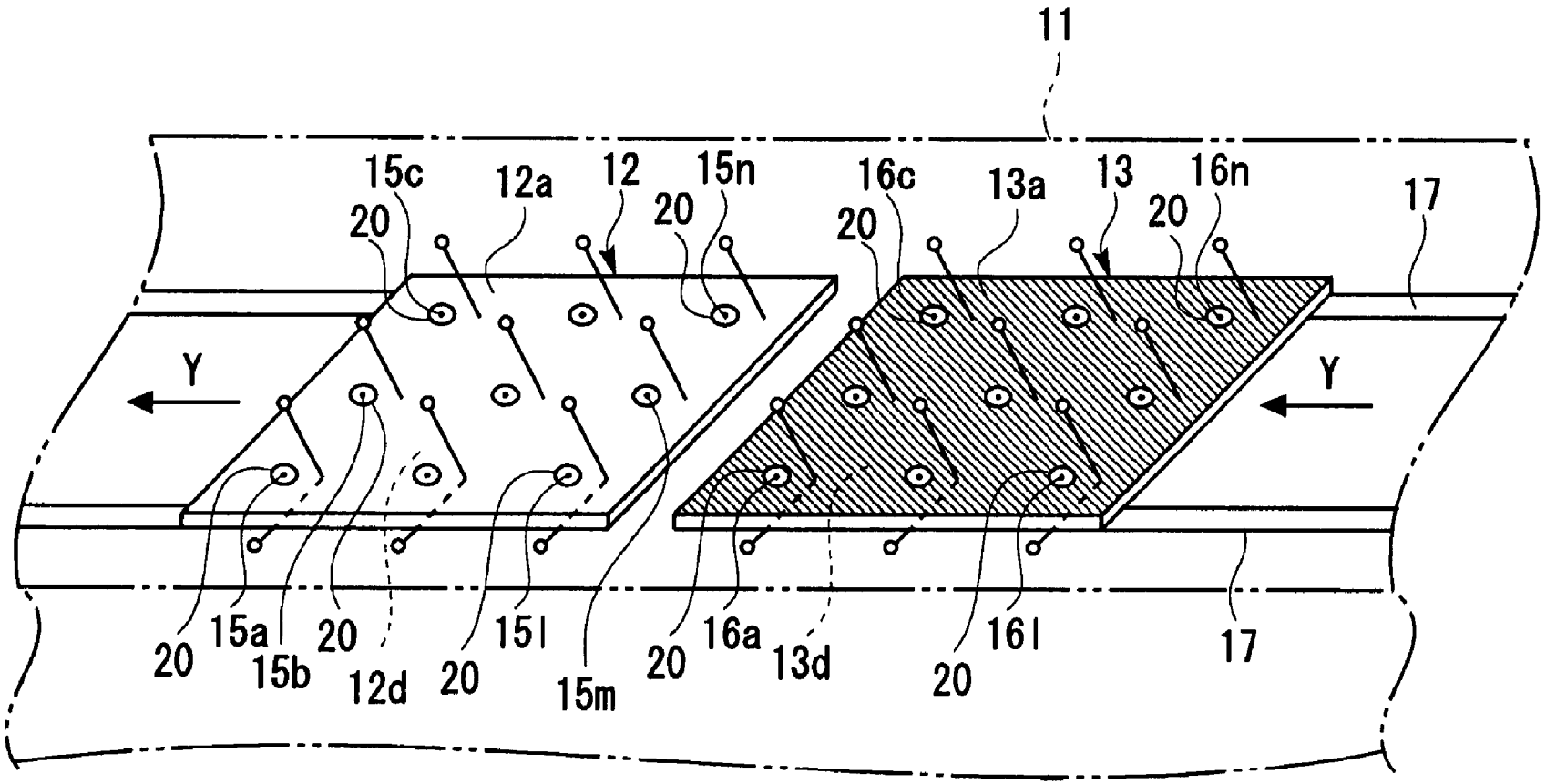
FIG. 1 is a schematic view for explaining a temperature measuring method within a reflow furnace according to the present invention.

FIG. 1 is a schematic view for explaining a temperature measuring method within a reflow furnace according to the present invention. According to the temperature measuring method within the reflow furnace, the first and second pseudo circuit boards 12 and 13 having substantially the same configuration and dimensions as those of the actual circuit boards are inserted into a reflow furnace 11 for soldering electronic parts (not shown) to a circuit board (not shown).

Then, the temperatures of front and rear surfaces 12*a*, 12*d*, 13*a*, and 13*d* of the first and second pseudo circuit boards 12 and 13, and the temperature of an air 17 (refer to FIG. 2) around the first and second pseudo circuit boards 12 and 13 within the reflow furnace 11 are measured.

Figure 2:
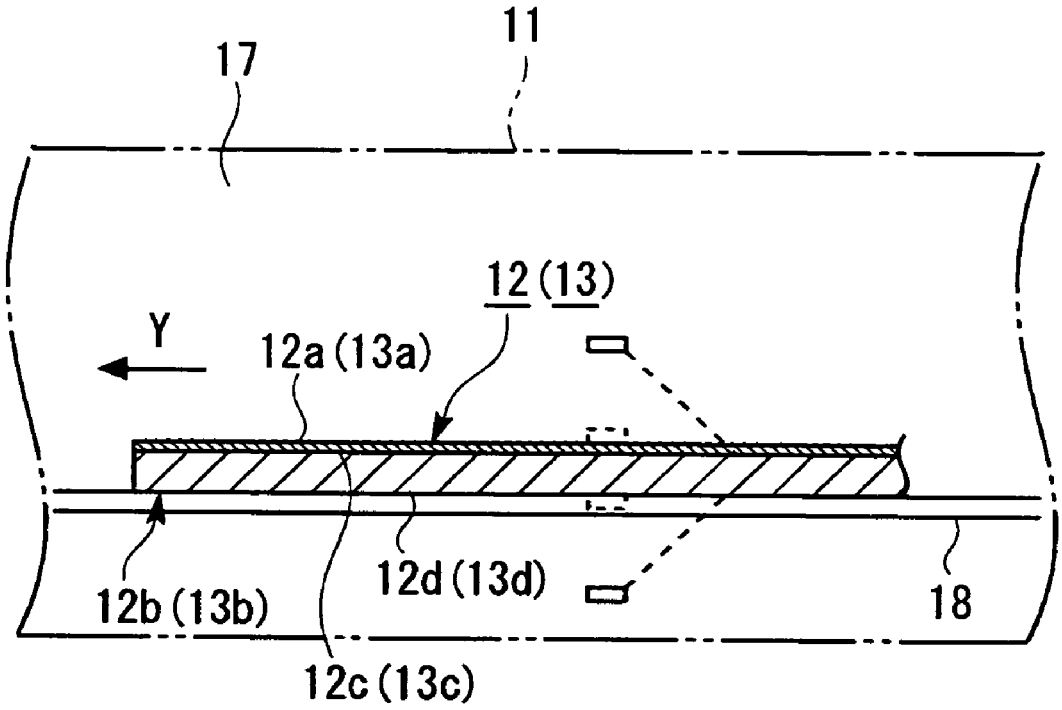
FIG. 2 is a cross-sectional view showing a pseudo circuit board according to the present invention.

In other words, according to the temperature measuring method within the reflow furnace, as shown in FIG. 2, the first pseudo circuit board 12 obtained by applying a black coating 12*c* to an entire surface of a metal plate 12*b* (refer to FIG. 12) whose given physical values such as specific heat ratio, density, or heat transfer coefficient have been known, and the second pseudo circuit board 12 obtained by giving a mirror finish 13*c* to surface of a metal plate 13*b* whose given physical values as described above have been known, are sequentially inserted into the reflow furnace 11.

An IC can be an example of the electronic part having a black surface, and a capacitor can be an example of the electronic part having a mirror-finished surface. The colors and the finish states of surfaces of most of the circuit boards and the electronic parts fall somewhere in between a black surface and a mirror-finished surface. Accordingly, the temperature is measured by two types of electronic parts each have a black surface and mirror-finished surface, thereby making it possible to cover almost all of the circuit boards and the electronic parts.

Subsequently, the first and second pseudo circuit boards 12 and 13 are conveyed within the reflow furnace 11 at substantially the same speed as that of an actual circuit board within the reflow furnace 11 in the same direction Y. Reference numeral 18 in FIG. 2 denotes conveying devices such as a belt.

Figure 3:
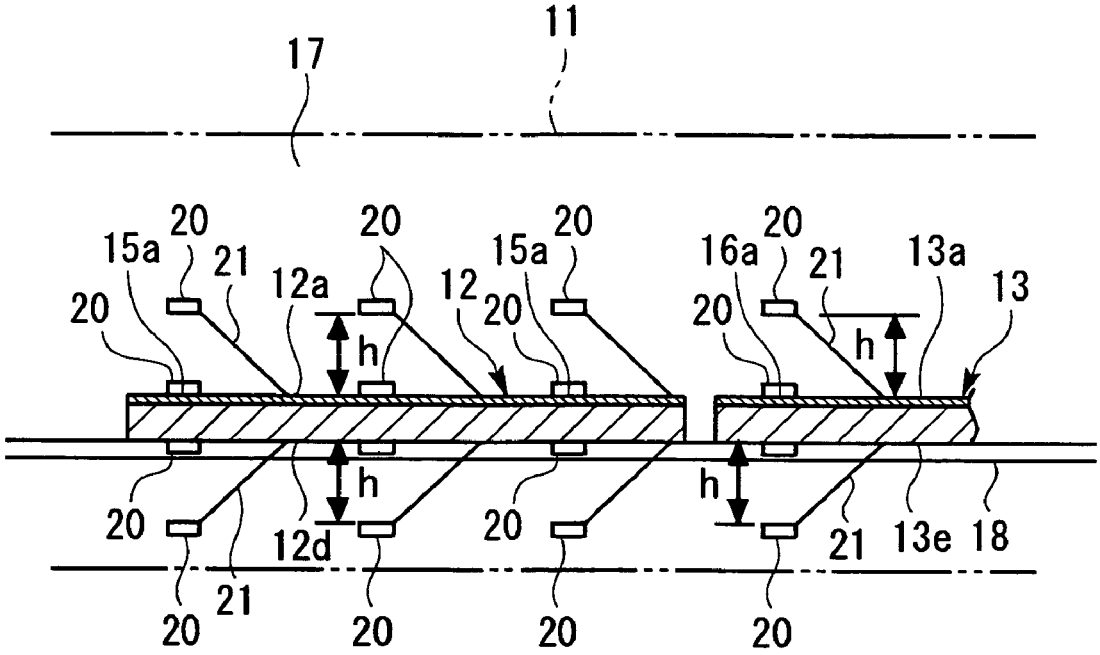
FIG. 3 is a cross-sectional view showing a pseudo circuit board and a temperature measurement position according to the present invention.
Figure 4:
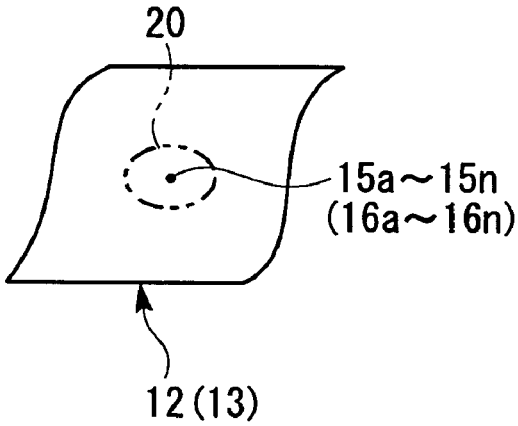
FIG. 4 is a plan view showing a given position of a pseudo circuit board and temperature measuring devices according to the present invention.
Figure 5:
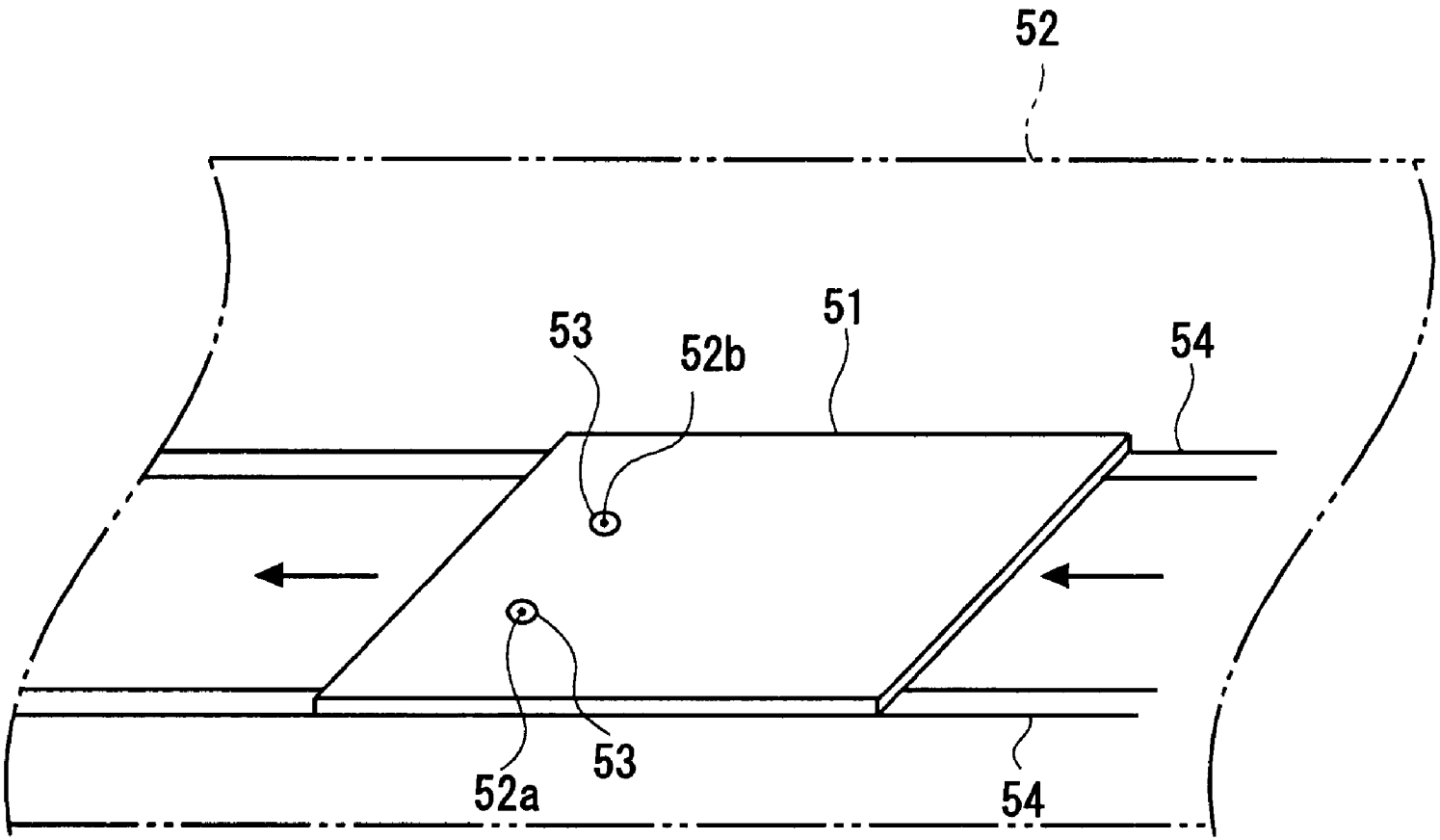
FIG. 5 is a schematic view showing a temperature measuring method within a reflow furnace according to a conventional example.

Subsequently, as shown in FIGS. 1, 3, and 4, the temperatures of the front and rear surfaces 12*a*, 12*d*, 13*a*, and 13*d* at given positions 15*a* to 15*n* and 16*a* to 16*n* on the first and second pseudo circuit boards 12 and 13, and the air temperatures around those given positions are measured. The temperature measuring devices can be exemplified by, for example, thermo couples 20.

The given positions 15*a* to 15*n* and 16*a* to 16*n* can be exemplified by positions at which electronic parts having the allowable temperature limit lower than that of the other electronic parts, among the electronic parts that are to be mounted on the actual circuit board, are mounted, or positions at which a heating temperature is higher than other portions.

Also, in this embodiment, the temperatures of the front and rear surfaces 12*a*, 13*d*, 13*a*, and 13*d* of the board at the given positions 15*a* to 15*n* and 16*a* to 16*n* on the first and second pseudo circuit boards 12 and 13, and of the air 17 positions apart upward and downward from those positions by a given distance h (ambient temperatures) are measured.

In this embodiment, the given distance h is set to 10 mm. This is because the heights of the electronic parts that are mounted on the actual circuit board generally fall within 10 mm.

The thermo couples 20 for measuring the temperatures of the air 17 above and below the given positions 15*a* to 15*n* and 16*a* to 16*n* are held to the first and second pseudo circuit boards 12 and 13 by linear members 21 that has the high heat resistance and strength such as a wire.

Subsequently, the operation of the in-reflow-furnace temperature measuring method will be described. In order to obtain the inherent characteristics within the reflow furnace 11 in more detail, it is necessary to accurately acquire not only the temperature of the front and rear surfaces of the circuit board that is an object to be manufactured but also the ambient temperature within the reflow furnace 11 and influence of the radiant heat within the reflow furnace 11.

Under the circumstances, in the present invention, an aluminum material or a material akin to aluminum is used as the materials 12*b* and 13*b* of the first and second pseudo circuit boards 12 and 13. Then, in order to measure the influence of the radiant heat within the reflow furnace 11, the surface of the first pseudo circuit board 12 is black-coated, and the surface of the second pseudo circuit board 13 is mirror-finished.

As a result, the temperature the first pseudo circuit board 12 having a black surface which is most easily affected by the radiant heat and the temperature of the second pseudo circuit board 13 having a mirror-finished surface which is hardly affected by the radiant heat can be measured at the same time.

As a result, the temperatures at the given positions and the air temperature around the given positions, which are necessary to obtain the inherent characteristics within the reflow furnace 11, can be measured by one operation for measuring temperatures.

In this example, the following temperatures are measured at the substantially same time. (1) Temperature of the surface 12*a* of the first pseudo circuit board 12 (black); (2) Ambient temperature above (in a vertical direction of) the surface 12*a* of the first pseudo circuit board 12; (3) Temperature of the rear surface 12*d* of the first pseudo circuit board 12; (4) Ambient temperature below (in a vertical direction of) the rear surface 12*d* of the first circuit board 12; (5) Temperature of the surface 13*a* of the second pseudo circuit board 13 (mirror-finished); (6) Ambient temperature above (in a vertical direction of) the surface 13*a* of the second pseudo circuit board 13; (7) Temperature of the rear surface 13*d* of the second pseudo circuit board 13; and (8) Ambient temperature below (in a vertical direction of) the rear surface 13*d* in the second pseudo circuit board 13.

According to the temperature measuring method within the reflow furnace of the present invention, the temperatures of the front surfaces (upper surfaces) 12*a*, 13*a*, and the rear surfaces (lower surfaces) 12*d*, 13*d* of the first and second pseudo circuit boards 12 and 13 within the reflow furnace 11, and the ambient temperatures above and below those circuit boards can be measured at once.

Accordingly, the variation of the measurement positions can be suppressed as compared with a conventional case in which the surface temperature of the measurement plate and the ambient temperatures above and below the measurement plate are individually measured, to thereby improve a precision in the temperature measurement.

Also, according to the present invention, the temperatures of the front and rear surfaces 12*a*, 12*d*, 13*a*, and 13*d* at the given positions of the first pseudo circuit board 12 whose entire surface is black-coated and the second pseudo circuit board 13 whose entire surface is mirror-finished, and the air temperatures around those front and rear surfaces are measured at the same time to thereby improve the efficiency of the temperature measurement operation.

Also, the first pseudo circuit board 12 and the second pseudo circuit board 13 are subjected to temperature measurement at the same time, the temperature measurement position can be prevented from being displaced between those two first and second pseudo circuit boards 12 and 13, thereby making it possible to increase the reliability of the temperature measurement results.

Also, the temperature within the reflow furnace 11 is measured by using the first pseudo circuit board 12 having a black-coated surface which is very high in the heat absorption and the second pseudo circuit board 13 having a mirror-finished surface which is very low in the heat absorption, thereby making it possible to use the temperature measurement results even in the case where the surfaces of the actual circuit board and the electronic parts that are mounted on the actual circuit board are different in the color and the finish state.

The following is the result of comparing a case in which the temperature within the reflow furnace 11 is measured with the conventional method with a case in which the temperature within the reflow furnace 11 is measured with the method of the present invention.

The temperature measurement according to the conventional method composed of two steps which take about 30 minutes in total, that is, 10 minutes for the in-furnace time, 5 minutes for the measurement standby time (15 minutes in subtotal), and temperature is measured twice or more. Also, according to the conventional method, the temperature of the object and the ambient temperature are separately measured. In addition, according to the conventional method, a variation of the temperature at the time of individual measurements is about 3° C., and a variation of the temperature in the case where the temperature is measured twice by using the same printed circuit board is 3° C. or higher.

The temperature measurement according to the present invention composed of two steps which take about 15 minutes in total, that is, 10 minutes for the in-furnace time, 5 minutes for the measurement standby time (15 minutes in subtotal), and temperature is measured once. In other words, according to the method of the present invention, the operation time can be reduced to ½ or less as compared with a case according to the conventional method.

Also, according to the method of the present invention, the temperatures of 8 kinds in total including the temperatures of the front and rear surfaces 12*a*, 12*d*, 13*a*, and 13*d* of those two first and second pseudo circuit boards 12 and 13 and the ambient temperatures can be measured at once. In addition, according to the method of the present invention, the measurement precision of temperatures can be expected to be improved by 6° C. or higher.

In the above embodiment, the case of measuring the temperature within the reflow furnace 11 was described. However, the present invention is not limited to the reflow furnace 11, but can be applied to the case of measuring the temperature within the various furnaces that require the temperature control.

In this case, the first pseudo circuit board 12 and the second pseudo circuit board 13 are replaced with the first and second pseudo objects to be heated having the substantially same configuration and dimension as those of the actual object to be heated. Then, the entire surface of the first object to be heated is black-coated, and the entire surface of the second pseudo object to be heated is mirror-finished.

<Others>

The disclosures of Japanese patent application No.JP2005-372309 filed on Dec. 26, 2005 including the specification, drawings and abstract are incorporated herein by reference.

What is claimed is:

1. An in-reflow-furnace temperature measuring method in which first and second pseudo circuit boards having the substantially same configuration and dimensions as those of a circuit board are inserted into a reflow furnace for soldering an electronic part onto the circuit board, the surface temperatures of the first and second pseudo circuit boards and air temperatures around the first and second pseudo circuit boards within the reflow furnace are measured comprising steps of;

black-coating the entire surface of a metal whose physical value is known in the first pseudo circuit board;

mirror-finishing the entire surface of a metal whose given physical value is known in the second pseudo circuit board;

conveying the first and second pseudo circuit boards within the reflow furnace at the substantially same speed as the conveying speed of the circuit board within the reflow furnace; and measuring the surface temperatures at given positions in the first and second pseudo circuit boards within the reflow furnace and air temperatures around the first and second pseudo circuit boards.

2. An in-reflow-furnace temperature measuring method according to claim 1 further comprising;

disposing temperature measuring devices at the given positions of the surfaces of the first and second pseudo circuit boards; and holding the temperature measuring devices above and below the given positions by holding devices.

3. An in-reflow-furnace temperature measuring method according to claim 1 further comprising;

the given positions are positions at which the electronic parts that are lower in allowable temperature limit than other electronic parts among the electronic parts are mounted, or positions at which the heating temperature by the reflow furnace is higher than others.

* * * * *

UNITED STATES PATENT AND TRADEMARK OFFICE

CERTIFICATE OF CORRECTION

PATENT NO. : 7,549,794 B2
APPLICATION NO. : 11/387868
DATED : June 23, 2009
INVENTOR(S) : Takashi Fukuda It is certified that error appears in the above-identified patent and that said Letters Patent is hereby corrected as shown below:

Column 7, Line 10, change "of;" to --of:--.

Column 8, Line 6, change "comprising;" to --comprising:--.

Column 8, Line 13, change "comprising;" to --comprising:--.

Signed and Sealed this

Twenty-seventh Day of October, 2009

David J. Kappos

David J. Kappos
*Director of the United States Patent and Trademark Office*